US005207429A

United States Patent [19]

Walmsley et al.

[11] Patent Number: 5,207,429

[45] Date of Patent: May 4, 1993

[54] CLUB AIMING UNIT

[75] Inventors: Richard G. Walmsley; Keith R. Degenhardt, both of Unley, Australia

[73] Assignee: Taracan PTY Ltd., Unley, Australia

[21] Appl. No.: 901,726

[22] Filed: Aug. 22, 1992

[30] Foreign Application Priority Data

Jun. 21, 1991 [AU] Australia ..... PK6787

[51] Int. Cl.[5] ..... A63B 69/36

[52] U.S. Cl. ..... 273/186.2; 273/194 R

[58] Field of Search ..... 273/186.3, 194 R, 186.2, 273/187.4, 194 A, 83; 434/252

[56] References Cited

U.S. PATENT DOCUMENTS

| | | | |
|---|---|---|---|
| 3,802,709 | 4/1974 | Elkins | 273/35 A X |
| 3,953,034 | 4/1976 | Nelson | 273/186.3 |
| 4,297,701 | 10/1981 | Henriques | 342/42 |
| 4,367,877 | 1/1983 | Gibson et al. | 273/187.4 |
| 4,997,189 | 3/1991 | Perkins | 273/192 |
| 5,029,868 | 7/1991 | Cloud | 273/186.3 |

*Primary Examiner*—George J. Marlo
*Attorney, Agent, or Firm*—Darby & Darby

[57] ABSTRACT

A club aiming unit for attachment to a club providing a means for enabling the orientation of the impact surface of a club head with respect to the target to be monitored during the swinging of a club. In particular, the invention is particularly useful in relation to croquet mallets or golf putters. The club aiming unit comprises a first light source producing a first planar beam of light having a narrow and substantially linear cross-section that projects a line of light onto a surface, and attachment means for mounting the first said light source to said club such that said first beam is projected over the preferred impact point of said impact surface with the plane of said first beam perpendicular to said impact surface, causing a line of light to be projected onto any surface immediately below the said club head. The projected line of light provides a reference mark which can be viewed during the swinging of the club, such that a person may concentrate their attention on the object being hit, while at the same time being able to see the movement of the projected line, thereby enabling the impact face of the club head to be maintained square to the target line. This provides a novel training means which enables a useful means of controlling the orientation of a club head during the swinging of the club.

17 Claims, 3 Drawing Sheets

CLUB AIMING UNIT

This invention relates to a club aiming device or unit and in particular relates to an aiming device or unit for a club that is used for hitting an object towards a target.

There are many examples of clubs, particularly sporting clubs, which are used to hit an object towards a target. Such examples include golf or croquet clubs. In these sports, either a putter or mallet is used to hit a stationary ball towards an intended target.

Such clubs normally comprise a shaft having at one end a handle, and at the other end a club head with an impact surface. In most circumstances, the impact surface is substantially vertical, and is obviously transverse to the target line, which is the line that extends towards the target.

Obviously, a successful strike of a ball resulting in the ball travelling towards the intended target is dependent solely upon the alignment or orientation of the club head impact surface at the point of contact with the ball. If the impact surface is anything but perfectly transverse to the target line, then the ball will not travel to the intended target. Provided that the initial set-up position is correct, and provided that during the swing the club head returns to will be hit in the desired direction along the target line.

Furthermore, it is generally accepted, particularly in respect of golf and the use of a putter, that the impact surface of the club head should remain square, or normal, to the target line both during the back swing, the forward swing and follow through. In order to maintain the impact surface square to the target line, it is necessary to rotate your hands in an anti-clockwise direction (for a right-handed person) in the back swing, and then to rotate your hands in a clockwise direction during the forward swing such that the club head arrives at a square position at the point of impact, and to continue rotating your hands in a clockwise direction during the follow through so as to again maintain the club head in a square position.

Such movement of the club head during the back swing, the forward swing and follow through, is extremely difficult to achieve, since the normal tendency when swinging a club is to pivot the torso about a central axis that coincides with the spine. This means that the club is being swung around your body, which means that if the hands are not rotated during the swing, that the impact surface will first open in relation to the target line, which means that the impact surface will point right of the target (for a right-handed person), and during the follow through will close with respect to the target line and point left of the target.

Further, the fact that the club head is being viewed from some distance, and given that the point of observation does not change as the club head moves back and through, the perspective is such that it is extremely difficult to gauge the position of the club head with respect to the target line.

In the past, devices have been proposed which indicate the orientation of the club head with respect to the target. Such devices include the use of light sources that direct a beam of light which is parallel to the intended target line. This will indicate a position to which the club head is being aimed provided that there is a surface onto which the beam of light may project.

However, the main problem with such known arrangements is that although it allows the correct orientation of the impact surface to be obtained prior to commencing a swing, they are not convenient in allowing the person to readily ascertain the orientation of the club head impact surface during the back swing, through swing and the follow through.

In many situations, and particularly in the use of a golf putter, it is imperative that a person swinging the club position their head such that they are looking directly at the object being hit. Once in this position, their head should not move and they should not attempt to look towards the target during the swing, as this will lead to a change in torso orientation and displacement of the club head swing path in relation to the intended target line. Invariably, an inaccurate hit will result.

Therefore, those devices which provide only an indication of the target are not useful in assessing the club head position during the swing when attention is focused on the ball being hit.

A further disadvantage of known target indicating devices using a light source is that they require major modifications to an existing club head, or a specifically built club head within which the light source is included. They may also include the use of mirrors which convert a downwardly directed beam to an horizontal beam. Such arrangements are complex, and costly to manufacture, and may not be readily adapted to an existing club.

Therefore, it is an object of this invention to overcome the abovementioned problems, and in particular it is an object of the invention to provide a club aiming unit which gives information as to the orientation of the impact surface of the club head during the swing of the club.

It is a further object of the invention to provide a club aiming unit which not only provides assistance in maintaining correct orientation of the impact surface of the club head during the swing, but also provides assistance in initial aiming of the impact surface prior to commencement of the swing.

In its broadest form, the invention comprises a club aiming unit for attachment to a club providing a means for enabling the orientation of the impact surface of the club head with respect to the target to be monitored during swinging of the club, said club aiming unit comprising a first light source producing a first planar beam of light having a narrow and substantially linear cross-section that projects the line of light onto a surface, and attachment means for mounting said first light source to said club such that said first beam is projected over the preferred impact point of said impact surface with the plane of said first beam perpendicular to said impact surface causing a line of light to be projected onto any surface immediately below said club head, said projected line of light providing a reference mark which can be viewed during the swing of the club.

Preferably, the projected line of light is projected across the club head such that it coincides with the centre point of the sweet spot of the club. This would be described as the preferred impact point of said impact surface, however it should be realised that the invention will be equally useful if the line of light is projected over another portion of the club head. This is due to the fact that during the swing of the golf club, the individual swinging the club concentrates on maintaining the projected line of light parallel with the initial position of this line of light prior to commencement of the swing. Therefore, as to whether or not the projected line of light coincides with the centre of the sweet spot is not critical to operation of the invention.

In accordance with the invention, provided that the impact surface of the club head is aimed in the correct direction, an individual swinging the club will have a reference mark which can be easily viewed when concentrating on the object being hit, and which will readily indicate if the orientation of the impact surface deviates from the intended target line, or in fact opens or closes during the swing.

Preferably, the first light source projects through a collimating lens to produce a collimated light beam, and that further this collimated light beam is directed through a cylindrical lens which then changes this collimated light beam to a planar beam of light having a narrow and substantially linear cross-section. The cylindrical lenses are generally well known by individuals skilled in the area of optics, and generally comprise a lens having in cross-section a cylindrical surface against which the light impinges, and having either a planar or cylindrical outer surface. It is well known that such a lens causes a beam of light to diverge to form a fan of light rather than a cone of light which would be produced with a spherical lens.

Preferably, the light source comprises a solid state laser, and in particular a semi-conductor laser diode. Preferably, a 670 nm wavelength light is used which is in the red visible spectrum. Alternatively, and particularly if the device is to be used in daylight conditions, a shorter wavelength light such as orange or green of 630–600 nm wavelength would be suitable. A 630 nm wavelength would be approximately three times more visible than a 670 nm wavelength in daylight.

In a further aspect of this invention, a second light source may be provided to produce a second collimated light beam which is directed towards the target to enable the impact surface of the club head to be aligned with respect to the target prior to commencement of the swing.

As an alternative to a second light source, the invention may comprise a first light source which projects through a collimating lens to produce a first collimated light beam, and further comprises a semi-transparent mirror upon which said first collimated light beam is directed, resulting in said light beam being split into two beams, the reflected light beam comprising said first planar beam of light, and the beam of light passing through the mirror comprising a second collimated light beam which is directed towards said target to enable the impact surface of the club head to be aligned with respect to said target.

Preferably, the reflected light source passes through a cylindrical lens which changes the beam into a planar beam of light. Alternatively, other means may be provided which causes the reflected beam of light to change into a planar beam of light having a narrow and substantially linear cross-section. These include having a curved surface on the semi-transparent mirror, or having an oscillating mechanical means which rapidly oscillates the reflected collimated beam back and forth so as to project a line of light over the club head.

Preferably, the light source, mirror and lens components of the club aiming unit are mounted in a substantially tubular housing. Further, the housing may comprise a first tubular portion containing the first light source, cylindrical lens or mirror, and the first tubular portion may be threadably engageable with a second tubular portion where the second tubular portion further comprises a recess for location of dry cell batteries therein, and electrical contacts enabling said first light source to be energised.

Preferably, the attachment means comprises a split coupling enabling one end of the attachment means to be clamped to said club, the other end of said attachment means having a cylindrical ring attached thereto, between which said first and second tubular portions may be threadably engaged thereby securing said tubular portions to said attachment means.

In order that the invention may be fully understood, preferred embodiments will now be described, however it should be realised that the scope of the invention is not to be restricted or confined to the precise details of these preferred embodiments.

The embodiments are illustrated in the accompanying drawings in which.

Figure 1:
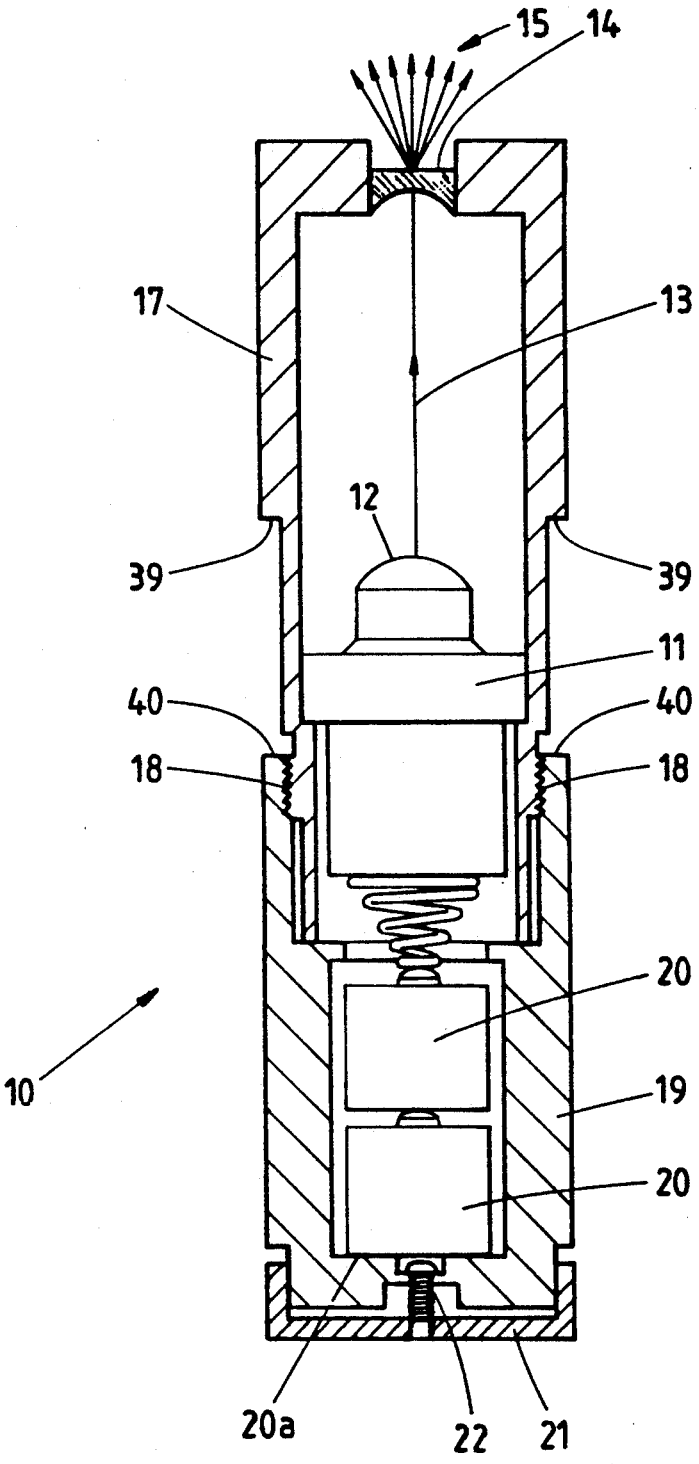
FIG. 1 shows a cross-sectional view of the club aiming unit.

In a first embodiment shown in FIG. 1, the club aiming unit 10 comprises a first light source 11 which in this embodiment comprises a solid state semi-conductor laser diode. The first light source 11 is fitted with a collimating lens 12 which produces a collimated light beam 13. The collimated light beam 13 is directed through a cylindrical lens 14 which produces a planar beam of light 15 having a narrow and substantially linear cross-section that will project a line of light onto a surface.

The first light source 11 and cylindrical lens 14 are mounted in a first tubular portion 17 which is threadably engageable via screw thread 18 with a second tubular portion 19. The second tubular portion 19 houses dry cell batteries 20 and electrical connection means 21. The electrical connection means 21 comprises a circular cap which can be screwed between two positions where in the first position the dry cells are isolated and therefore the light source remains de-energised, and into a second position where the threaded post 22 comes into contact with the base of the dry cell 20. The base **20*a* of the lower dry cell 20 is electrically isolated from the second tubular portion 19, and therefore the electric circuit is only completed when the post 22 makes contact with the dry cell 20**.

Figure 2:
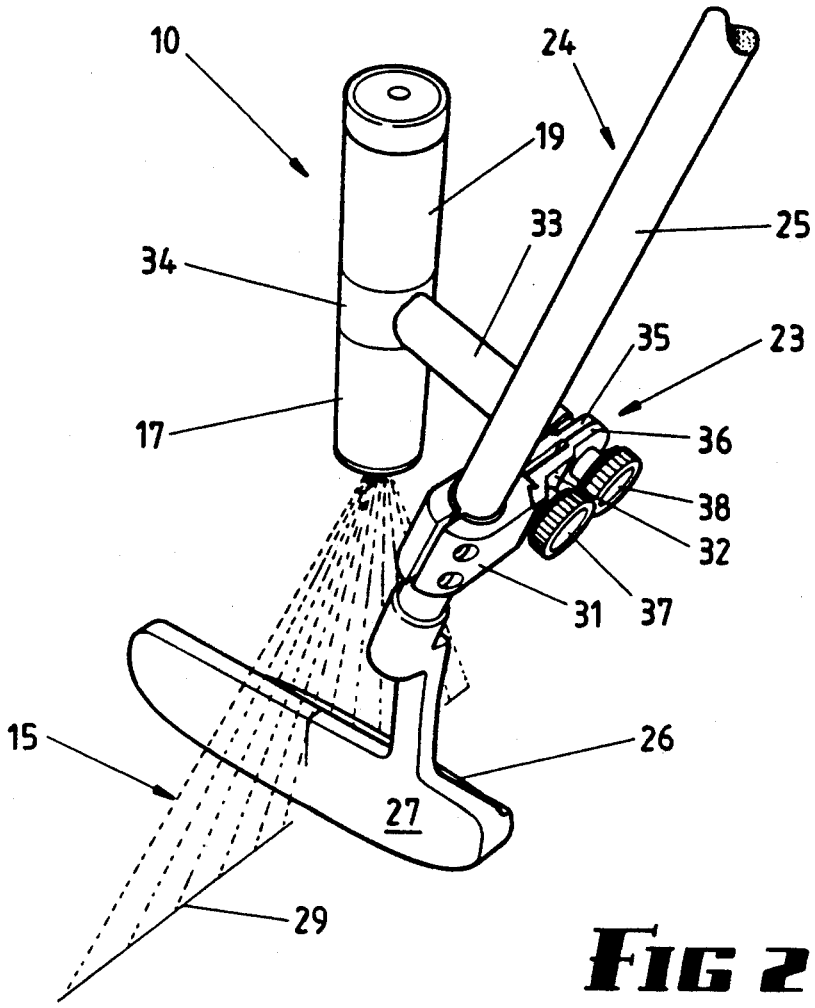
FIG. 2 shows the club aiming unit according to FIG. 1 attached to the shaft of a golf putter.

As seen in FIG. 2, the club aiming unit 10 is secured via attachment means 23 to a club 24. The club 24 comprises a club shaft 25, a club head 26 having a club impact face 27.

The club aiming unit 10 is attached to the club shaft 25 such that the planar beam of light 15 is directly over the preferred impact point on the impact face 27 which coincides with the centre of the sweet spot of the club 24, and the club aiming unit 10 is further arranged such that the planar beam of light 15 is perpendicular to the club impact face 27, and projects a line of light 29 onto the surface immediately below the club head 26.

Figure 5:
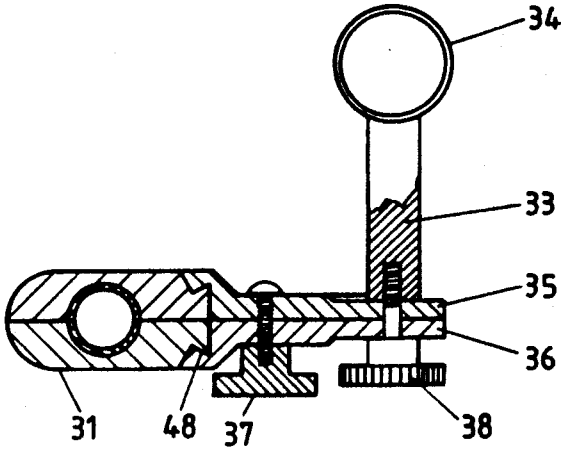
FIG. 5 shows a cross-sectional view of the attachment means.

The attachment means 23 comprises a split coupling 31, a clamp arm 32, a spindle 33 and a ring or collar 34. The split coupling 31 comprises a pair of halves which are clamped via threaded screws around the club shaft 25. The split coupling is separable from the clamp arm 32, and may be left permanently in place to provide a means of easily attaching the club aiming unit 10 to the club 24. The clamp arm 32 comprises a pair of plates 35 and 36 having a dovetail fitting at one end which corresponds to a dovetail fitting 48 on the split coupling 31. The dovetail fitting 48 is more fully illustrated in FIG. 5. The plates 35 and 36 are held together by a threaded shaft 37 which allows for opening and closing of the plates 35 and 36 to allow release or coupling of the clamp arm 32 to the split coupling 31. The spindle 33 is connected to the clamp arm 32 via threaded shaft 38 such that loosening of the threaded shaft 38 enables adjustment of the club aiming unit 10 in a vertical plane.

As seen in FIG. 2, the first and second tubular portions 17 and 19 threadably engage between the collar 34. As seen in FIG. 1, the first tubular portion 17 is provided with shoulders 39 which abut on the lower edge of the collar 34, and the end 40 of the second tubular portion 19 abuts against the upper surface of the collar 34. Again, by loosening the threaded coupling 18 between the first and second tubular portions 17 and 19, the axial orientation of the club aiming unit 10 may be adjusted for accurate positioning of the planar beam of light 15 over the club head 26.

As seen in FIG. 2, the club aiming unit 10 causes a line of light to be projected over the club head 26 such that a line of light 29 is projected onto the surface immediately below the club head 26. Preferably, this line of light 29 projects for a short distance forward of the club head impact face 27. During the swinging of the club, it is this line of light which a person focuses their attention upon, and by maintaining the projected line of light 29 parallel to the initial start position, then the orientation of the impact face 27 can be maintained square to the target line.

Figure 3:
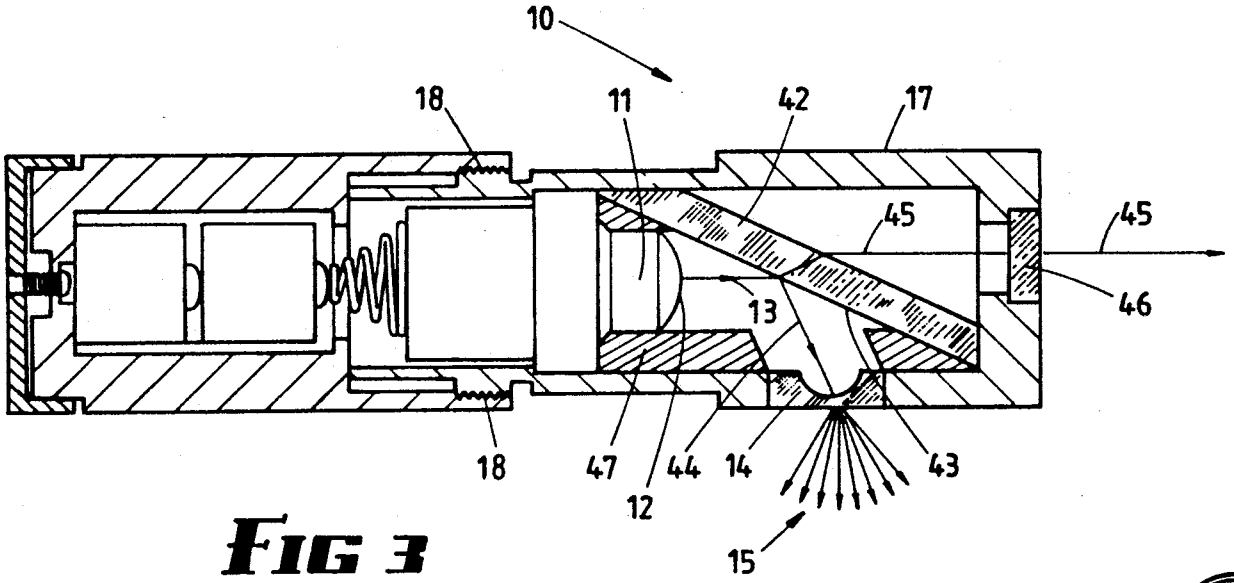
FIG. 3 shows a cross-sectional view of a second preferred embodiment of the club aiming unit.

A second preferred embodiment is illustrated in FIG. 3 which shows the first tubular portion 17 housing a first light source 11, a cylindrical lens 14 and a semi-transparent mirror 42. In this embodiment, the first light source 11 comprises a solid state laser, and has a collimating lens 12 attached thereto. The light source 11 produces a first collimated beam 13 which impinges against the inside surface 43 of the semi-transparent mirror 42. This has the effect of splitting the collimated light beam 13 into a reflected beam 44 and into a collimated light beam 45 which passes through the semi-transparent mirror 42.

The collimated beam passes through a window 46 and the reflected beam 44 is directed towards the cylindrical lens 14. As in the previous embodiment, the reflected beam 44 passes through the cylindrical lens 14, which causes a reflected beam to be changed into a planar beam of light 15. As in the previous embodiment, the first tubular portion 17 has a circular cross-section, however as a relatively thin collimated light beam is emitted from the first light source 11, the semi-transparent mirror 42 and cylindrical lens 14 are narrow and strip-like in nature, and are located in a channel portion formed in an inner retainer member 47 which is located within the first tubular portion 17. The inner retainer member has a cylindrical external surface, with a milled slot through the centre for location of the semi-transparent mirror 42, and a further slot milled therein through which the reflected beam 44 passes. Further, the first tubular portion 17 is provided with the necessary apertures for location of the cylindrical lens 14, and of window 46.

The remainder of the club aiming unit 10 as shown in FIG. 3 is similar to the first preferred embodiment as illustrated in FIG. 1.

Figure 4:
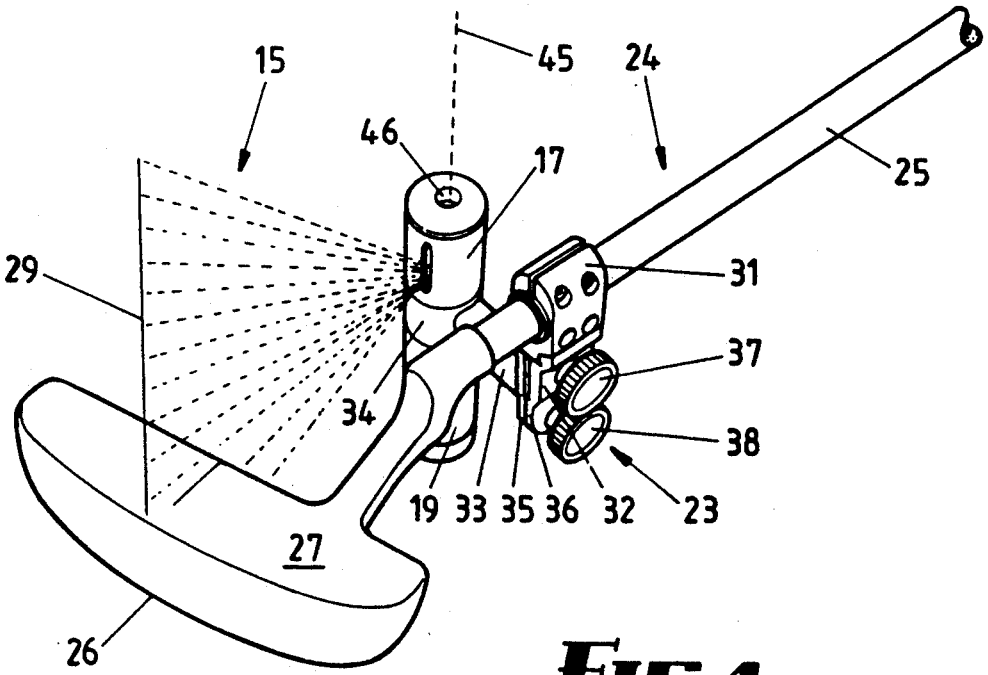
FIG. 4 shows a perspective view of the club aiming unit according to the second preferred embodiment attached to the shaft of a golf putter.

FIG. 4 shows the club aiming unit 10 according to the second preferred embodiment attached to the shaft 25 of a club 24. The club aiming unit 10 is secured to the club shaft 25 via attachment means 23. The attachment means 23 as shown in FIG. 4 is identical to the attachment means 23 as shown in FIG. 2. As illustrated, the attachment means 23 provides adjustment of the club aiming unit 10 about the axis of the spindle 33 so as to adjust the position of the collimated beam 45 with respect to the target. In one aspect, if the target comprises a hole in an horizontal surface, then the club aiming unit 10 can be adjusted such that the collimated beam 45 projects onto a point on the ground just before the hole. Alternatively, during practice, balls may be struck towards a target on a vertical surface, and therefore the collimated beam 45 can be positioned so as to project onto the vertical surface.

In addition, the threaded engagement 18 between the first tubular portion 17 and second tubular portion 19 may be loosened so as to allow the club aiming unit 10 to be rotated about its longitudinal axis, thereby adjusting the position of the projected line 29. By producing the spindle 33 of the required length, and by adjusting the position of the split coupling 31 along the club shaft 25, then the projected line 29 can be positioned directly above the centre of the sweet spot of the club head 26. As seen in FIG. 4, the projected line 29 projects directly over the club head 26, and in front of the club impact face 27.

In use, a person using the club 24 with the club aiming unit 10 attached, would firstly place the club head 26 behind a ball that is to be struck towards a target, and then to look at the projected collimated beam 45 and its position in relation to the target. If the club impact face 27 has been misaligned, then this will be readily ascertained by the position of the projected collimated beam 45.

The position of the club head 26 can then be accurately aligned to ensure that the club impact face 27 is pointing directly towards the target.

The person swinging the club then concentrates on the projected line of light 29, and ensures that as the club 24 is swung, during the back swing, the through swing and the follow through, the line of light 29 is maintained parallel to the original orientation prior to the swing commencing, and that the person swinging the club adjusts the rotation of the club head 26 such that the projected line of light 29 does not rotate or otherwise deviate from the intended target line.

Practising with the club aiming unit 10 attached to the club 24 provides a much easier means of identifying the position of the club impact face 27 during the swing of the club 24. Any person familiar with the swinging of either a croquet club or a golf putter will readily admit that it is extremely difficult to focus on the club head 26 and the orientation of the club impact face 27 during the swinging of the club 24. In particular, it is a generally accepted principle in the swinging of a golf putter, that a person concentrate their vision on the ball being hit.

Therefore, the invention provides a means by which the person may continue to watch the object being struck, while at the same time being able to view peripherally the projected line of light 29, and therefore have some marker or reference point which indicates the orientation of the club impact face 27.

A brief consideration of the above details will indicate that the invention provides a unique and novel means of assisting in the training of the use of various clubs, particularly in relation to croquet and golf.

We claim:

1. A club aiming unit for attachment to a club providing a means for enabling the orientation of the impact surface of the club head with respect to the target to be monitored during the swinging of the club, said club aiming unit comprising a first light source producing a first planar beam of light having a narrow and substantially linear cross-section that projects a line of light onto a surface, and attachment means for mounting said first light source to said club such that said first beam is projected over the preferred impact point of said impact surface with the plane of said first beam perpendicular to said impact surface causing a line of light to be projected onto any surface immediately below said club head, said projected line of light providing a reference mark which can be viewed during the swing of the club.

2. A club aiming unit according to claim 1 wherein said first light source projects through a collimating lens to produce a first collimated light beam, and further comprising said first collimated light beam being directed through a cylindrical lens which changes said first collimated light beam into said first planar beam of light.

3. A club aiming unit according to claim 2 wherein said first light source comprises a solid state laser.

4. A club aiming unit according to claim 3 further comprising a tubular housing containing said first light source and said cylindrical lens.

5. A club aiming unit according to claim 4 wherein said tubular housing further comprises a first tubular portion containing said first light source and said cylindrical lens and a second tubular portion threadably engageable with said first tubular portion and having a recess therein for location of dry cell batteries therein, and electrical contacts enabling said first light to be energised.

6. A club aiming unit according to claim 5 wherein said attachment means comprises a split coupling enabling one end of said attachment mean to be clamped to said club, the other end of said attachment means having a cylindrical ring attached thereto, between which said first and second tubular portions may threadably engage thereby securing said tubular portions to said attachment means.

7. A club aiming unit according to claim 6 wherein the length of said attachment means positions the longitudinal axis of said first planar beam of light directly over the centre of the sweet spot of the impact surface of said club.

8. A club aiming unit according to claim 1 further comprising a second light source producing a second collimated light beam which is directed towards said target to enable the impact surface of the club head to be aligned with respect to said target.

9. A club aiming unit according to claim 1 wherein said first light source projects through a collimating lens to produce a first collimated light beam, and further comprising a semi-transparent mirror upon which said first collimated light beam is directed, resulting in said beam being split into two beams, the reflected light beam comprising said first planar beam of light, and the beam of light passing through the mirror comprising a second collimated light beam which is directed towards said target to enable the impact surface of the club head to be aligned with respect to said target.

10. A club aiming unit according to claim 9 further comprising a cylindrical lens wherein said reflected light beam is directed through said cylindrical lens which changes said beam into said first planar beam of light.

11. A club aiming unit according to claim 10 wherein said first light source comprises a solid state laser.

12. A club aiming unit according to claim 11 further comprising a tubular housing containing said first light source, said mirror and said cylindrical lens.

13. A club aiming unit according to claim 12 wherein said housing comprises a first tubular portion containing said first light source, said mirror and said cylindrical lens, said first tubular portion being threadably engageable with a second tubular portion, said second tubular portion further comprising a tubular recess for location of dry cell batteries therein, and electrical contacts enabling said first light source to be energised.

14. A club aiming unit according to claim 13 wherein said attachment means comprises a split coupling enabling one end of said attachment means to be clamped to said club, the other end of said attachment means having a cylindrical ring attached thereto, between which said first and second tubular portions may threadably engage thereby securing said tubular portions to said attachment means.

15. A club aiming unit according to claim 14 wherein the length of said attachment means positions said first planar beam of light, and the longitudinal axis of said second collimated beam of light directly over the centre of the sweet spot of the impact surface of said club.

16. A club aiming unit according to claim 15 wherein the club comprises a golf putter and said attachment means is secured to the shaft of said putter.

17. A club aiming unit according to claim 16 including split coupling which is disconnectable from said attachment means and is left on said shaft when said attachment means is disconnected.

* * * * *